US005525171A

United States Patent [19]

Finck et al.

[11] Patent Number: 5,525,171

[45] Date of Patent: Jun. 11, 1996

[54] PYROTECHNIC COMPOSITIONS GENERATING CLEAN AND NONTOXIC GASES, CONTAINING A THERMOPLASTIC ELASTOMER BINDER

[75] Inventors: Bernard Finck, Corbeil; Alain LeFumeux, Orsay; Christian Perotto, Ballancourt, all of France

[73] Assignee: Societe Nationale des Poudres et Explosifs, Paris, France

[21] Appl. No.: 337,211

[22] Filed: Nov. 7, 1994

[30] Foreign Application Priority Data

Dec. 7, 1993 [FR] France ..... 93 14642

[51] Int. Cl.[6] ..... C06B 45/10

[52] U.S. Cl. ..... 149/19.6; 149/19.1; 149/19.5; 149/20; 149/45

[58] Field of Search ..... 149/45, 19.6, 19.1, 149/19.5, 20

[56] References Cited

U.S. PATENT DOCUMENTS

| | | | |
|---|---|---|---|
| 3,004,840 | 10/1981 | Pruitt et al. | 52/5 |
| 4,547,235 | 10/1985 | Schneiter et al. | 149/35 |
| 4,806,613 | 2/1989 | Wardle | 528/59 |
| 4,875,949 | 10/1989 | Mishra et al. | 149/19.3 |
| 4,925,503 | 5/1990 | Canterberry et al. | 149/19.4 |
| 5,223,056 | 6/1993 | Ahad | 149/19.6 |
| 5,256,804 | 10/1993 | Ampleman | 522/10 |

FOREIGN PATENT DOCUMENTS

| | | | |
|---|---|---|---|
| 0533599 | 12/1983 | Australia . | |
| 0353961 | 2/1990 | European Pat. Off. | C06B 45/10 |
| 0553476 | 8/1993 | European Pat. Off. . | |
| 1190001 | 4/1970 | United Kingdom . | |

*Primary Examiner*—Donald P. Walsh
*Assistant Examiner*—Anthony R. Chi
*Attorney, Agent, or Firm*—Cushman Darby & Cushman

[57] ABSTRACT

The present invention relates to the field of gas-generating pyrotechnic compositions intended for motor vehicle safety.

The compositions according to the invention include:

an oxygen-containing thermoplastic binder and especially a block aliphatic copolymer of formula:

$$HO\left[\underset{\underset{O}{\|}}{C}-PA-\underset{\underset{O}{\|}}{C}-O-PE-O\right]_n H$$

in which:
PA is a polyamide block,
PE is a polyether block,
n is a number between 2 and 10, an energetic plasticizer which is a polyglycidyl azide, an oxidizing charge in which at least 85% of its weight consists of ammonium nitrate.

The compositions according to the invention burn without solid residues and can be employed in gas generators without a filter chamber.

8 Claims, No Drawings

PYROTECHNIC COMPOSITIONS GENERATING CLEAN AND NONTOXIC GASES, CONTAINING A THERMOPLASTIC ELASTOMER BINDER

The present invention relates to the field of motor vehicle safety and, more precisely, to that of protection, in the event of collision, of the occupants of a motor vehicle by virtue of bags inflated with the combustion gases from a pyrotechnic composition contained in a gas generator. The invention relates to pyrotechnic compositions generating clean and nontoxic gases, containing a thermoplastic binder.

In order to ensure the safety of the occupants of a motor vehicle in the event of collision, it is known to inflate protective bags by means of combustion gases from pyrotechnic compositions contained in gas generators. The combustion gases thus produced must be nontoxic to the vehicle occupants and must be capable of being produced over very short periods of the order of a few tens of milliseconds. The original pyrotechnic compositions satisfying these requirements adopted by the specialist were essentially compositions made up of an alkali or alkaline-earth metal azide and an inorganic oxidizing agent. Such compositions are, for example, described in Patent U.S. Pat. No. 4,547,235. These compositions do provide gases in the conditions required by motor vehicle safety but also, on burning, produce a large quantity of solid residues which form hot spots which must not enter the protective bag.

The use of these compositions therefore requires gas generators equipped with powerful means for filtering the gases.

At the same time, since about twenty years ago, motor vehicle manufacturers have wished to have at their disposal simple generators without any filter chamber, or fitted with a very simple and very light filter chamber, the aim being to reduce the weight of the safety devices and to lower their costs.

The specialist is therefore looking for pyrotechnic compositions which provide clean gases without solid residues on burning, in time and nontoxicity conditions which are compatible with motor vehicle safety requirements.

After having explored propellent powders based on nitrocellulose and nitroglycerine, which burn rapidly without any solid residue but which do not always give complete satisfaction with regard to the nontoxicity of the gases, the specialist has turned towards so-called "composite" compositions consisting of an organic binder and an inorganic or organic oxidizing agent. Nevertheless, the great difficulty with compositions of this type, which are frequently rich in carbon and in inorganic elements, is to satisfy simultaneously the three requirements of:

i) nontoxicity of the gases, ii) high burning rate, iii) absence of solid residues or, in any event, very small quantity of solid residues.

However, French Patent Application 9207067 filed on 12 June 1992 proposed a type of composition which satisfies this threefold requirement.

The compositions described in this application consist chiefly of the product of reaction of a glycidyl polyazide with a polyisocyanate as binder and of ammonium nitrate as oxidizing charge. These compositions give full satisfaction with regard to the nontoxicity of the gases, the burning speed and the absence of solid residues, but are nevertheless difficult to process, especially in continuous processes involving an extrusion stage, because they rely on crosslinkable binders which cure very quickly.

The use of a thermoplastic binder in composite compositions of this type would permit easier processing, especially in the case of continuous processes; however, while the use of pyrotechnic compositions containing a thermoplastic binder as rocket propellants or as explosives is known, for example from Patents U.S. Pat. Nos. 4,806,613, 4,875,949 and 4,925,503, their use in motor vehicle safety has not been widespread hitherto. In fact, composite pyrotechnic compositions containing a thermoplastic binder which are hitherto known do not satisfy all the requirements called for in this field.

A specialist is therefore looking for pyrotechnic compositions generating clean and nontoxic gases, which burn at a rate compatible with the requirements of motor vehicle safety and which are easy to process on an industrial scale.

The objective of the present invention is precisely to propose such compositions.

The invention relates therefore to a pyrotechnic composition whose combustion products are chiefly nontoxic clean gases, consisting essentially of a binder which is a thermoplastic elastomer, of an energetic plasticizer, of an inorganic oxidizing charge and of additives intended to control the burning, characterized in that the said binder is an oxygen-containing thermoplastic elastomer, in that the said plasticizer is a product of polymerization of glycidyl azide and in that at least 85% of the weight of the said oxidizing charge consists of ammonium nitrate.

According to a first preferred alternative form of the invention the said binder is a block copolymer consisting chiefly of polyamide units and polyether units.

According to a second preferred alternative form of the invention the said energetic plasticizer is a polyglycidyl azide with hydroxyl ends whose number-average molecular mass is between 1,000 and 7,000.

According to a third preferred alternative form of the invention the said additives are chosen from the group consisting of potassium nitrate and ammonium perchlorate.

According to a last preferred alternative form of the invention the binder/energetic plasticizer combination represents between 5 and 15% of the total weight of the composition, the weight of the energetic plasticizer representing approximately 30% of the binder weight.

The compositions according to the invention burn quickly giving off, as combustion gases, essentially nitrogen and carbon dioxide, with very little carbon monoxide. Furthermore, they produce no, or few, solid residues, depending on the additives employed.

They can therefore be advantageously employed in pyrotechnic gas generators intended to inflate protective bags for occupants of a motor vehicle. Furthermore, the presence of an elastomer as binder endows the granules or the blocks of pyrotechnic composition with mechanical properties which are particularly advantageous for products intended to be stored for many years in a motor vehicle.

A detailed description of the invention is given below.

The invention relates therefore to pyrotechnic compositions whose combustion products are chiefly clean and nontoxic gases. These compositions consist essentially of a binder, of an energetic plasticizer, of an inorganic oxidizing charge and of additives intended to control the burning of the composition.

According to a first essential characteristic of the invention the binder employed is an oxygen-containing thermoplastic elastomer, thermoplastic elastomers not containing oxygen not being included within the scope of the present invention because they produce combustion gases which are too rich in carbon monoxide and therefore too toxic for motor vehicle safety requirements. As binder, preference will be given to block aliphatic copolymers consisting chiefly of blocks containing polyamide units and of blocks containing polyether units and whose molecular mass is lower than 20,000. A binder which is particularly preferred within the scope of the present invention consists of a block aliphatic copolymer of formula:

$$HO\left[\underset{\underset{O}{\|}}{C}-PA-\underset{\underset{O}{\|}}{C}-O-PE-O\right]_n H$$

in which:

C, H and O denote carbon, hydrogen and oxygen respectively,

PA denotes a polyamide block obtained by condensation of dodecanedioic acid with 1,12-dodecanediamine, PE denotes a polyether block obtained by condensation of tetramethylene glycol, n denotes an integer between 2 and 10.

This type of block copolymer is marketed by the company Atochem under the trade name Pebax®.

According to a second essential characteristic of the invention an energetic plasticizer which is a product of polymerization of glycidyl azide is added to the binder. A preferred class of energetic plasticizers consists of polyglycidyl azides with hydroxyl ends, whose number-average molecular mass is between 1000 and 7000 and, preferably, between 1500 and 2500.

These polyglycidyl azides correspond to the following formula:

$$H\left[OCH_2-\underset{\underset{CH_2N_3}{|}}{CH}\right]_m OH$$

in which:

C, H, O and N denote carbon, hydrogen, oxygen and nitrogen respectively, m denotes an integer generally between 5 and 100.

It is appropriate to stress that, within the scope of the present invention, the polyglycidyl azides with hydroxyl ends do not take part in any chemical condensation reaction; they are therefore indeed employed as energetic plasticizer for the thermoplastic elastomer and not as a constituent component of the binder, as is generally the case when they are employed in the presence of an isocyanate or of another agent that reacts with the OH hydroxyl groups.

The binder/energetic plasticizer combination preferably represents between 5% and 15% of the total weight of the composition, while the weight of the said energetic plasticizer preferably represents approximately 30% of the weight of the binder/plasticizer combination. It is thus noted that the invention makes it possible, by virtue of the use of an appropriate thermoplastic binder, to employ composite compositions which have a relatively low binder content, and this is very advantageous with regard to the nontoxicity of the gases.

According to a third essential characteristic of the invention the pyrotechnic composition contains an oxidizing charge in which at least 85% of its weight consists of ammonium nitrate.

A stabilized ammonium nitrate will be advantageously employed. The stabilizer may, for example, consist of a little nickel oxide NiO. This grade of ammonium nitrate is sold in the trade and generally contains 3% by weight of nickel oxide in relation to pure ammonium nitrate. In the present description the expression "ammonium nitrate" covers the combination consisting of pure ammonium nitrate and of the stabilizer which may be present. Although nickel oxide is noncombustible, its presence in a small quantity turns out not to be an impediment within the scope of the present invention.

All of the oxidizing charge may consist of ammonium nitrate, but it is absolutely essential within the scope of the present invention that the ammonium nitrate should represent, on a weight basis, at least 85% of the oxidizing charge.

When the oxidizing charge does not consist exclusively of ammonium nitrate, it may be supplemented with triaminoguanidinium nitrate, with nitroguanidine or else with a nitramine such as RDX or HMX.

The compositions according to the invention advantageously also contain additives intended especially to control the rate of burning of the composition in the pressure range corresponding to the operation of the generator. These additives exclude metals or metal compounds capable of forming solid residues that can be entrained by the combustion gases. These additives may, for example, be carbon black or m-methyl-p-nitroaniline. According to a preferred embodiment of the invention these additives may also be chosen from the group consisting of potassium nitrate and ammonium perchlorate, the additives also acting as an oxidizing charge in this latter case. Preferred compositions within the scope of the present invention contain a mixture of potassium nitrate and ammonium perchlorate as additives, the potassium nitrate representing approximately 7% of the weight of ammonium nitrate and the ammonium perchlorate representing between 4 and 6% of the total weight of the composition.

The formulation and the forming of the compositions according to the invention can be easily carried out continuously or noncontinuously in a blender-extruder, by employing solvent or solvent-free techniques which are known to a specialist.

In solvent-free processing the softening of the binder when heated is exploited to ensure the coating of the oxidizing charge with the binder. The binder and the energetic plasticizer are introduced into a blender extruder heated generally to a temperature of between 80° C. and 130° C. and preferably to a temperature close to 120° C., and the oxidizing charge and the optional additives are then added. When the coating of the charge and of the additives with the binder is completed the dough obtained is extruded with the desired geometry and is left to cool.

Particles, strands or even small blocks of composition according to the invention are thus obtained.

In processing with solvent the binder is dissolved with the aid of an appropriate solvent in a blender extruder. The solvent for the binder must not dissolve or chemically attack the oxidizing charge and the additives. The solvents employed will be advantageously light alcohols such as ethanol, propanol and preferably butanol, light hydrocarbons such as kerosene or benzene, methyl ethyl ketone or chlorinated or fluorinated hydrocarbons such as methylene chloride, trichloroethylene, perchloroethylene or trichlorofluoromethane. The energetic plasticizer, the oxidizing charge and the optional additives are then added. After a homogeneous dough is obtained, the latter is extruded with the desired geometry and the solvent is stripped off by evaporation, optionally accompanied by slight heating.

The use of a solvent technique is particularly recommended when the binder has a softening temperature which is too high for the energetic plasticizer or for the oxidizing charge.

With the products thus obtained the pyrotechnic filling of a gas generator is easily formed either as a filling of particles in bulk or as a bundle of elongate strands or else as a block which has a geometry adapted to that of the combustion chamber of the generator.

The compositions according to the invention burn at rates which are compatible with the requirements of motor vehicle safety, releasing combustion gases consisting essentially of nitrogen and carbon dioxide, their carbon monoxide content lying within limits accepted for motor vehicle safety. Furthermore, these compositions do not produce, or produce very few, solid residues, with the result that they can be employed in gas generators without any filter chamber or provided with very simple filtering devices. Finally, the presence of a binder that is an elastomer which has elastic properties improves the mechanical strength of the fillings arranged inside the gas generators.

The examples which follow, given without any limitation being implied, illustrate some possibilities of implementation of the invention.

EXAMPLE 1

An 8-g annular block which had the following composition was manufactured by a solvent- free technique:

binder: "Pebax" 2533 resin: 8.6 parts by weight (comprising, by weight, 20% of PA units and 80% of PE units as defined above)

energetic plasticizer:3.4 parts by weight polyglycidyl azide of mass 2,000 ammonium nitrate:88.0 parts by weight

This block was burnt in a gas generator. Burning took place without any solid residues and the carbon monoxide content referred to a working volume of 2.7 $m^3$, which is the standard volume of a motor vehicle cabin, was 40 ppm.

By way of comparison, a block of 8 g of dual-base powder containing nitrocellulose and nitroglycerine gives a similar gas yield but provides a carbon monoxide content of 1,000 ppm in the case of a working volume of 2.7 $m^3$.

EXAMPLE 2

An 8-g annular block which had the following composition was manufactured by a solvent-free technique:

binder:"Pebax" 2533 resin:8.6 parts by weight energetic plasticizer:3.4 parts by weight polyglycidyl azide of mass 2,000 ammonium nitrate:75.6 parts by weight potassium nitrate:8.4 parts by weight ammonium perchlorate:4.0 parts by weight This block was burnt in a gas generator. Burning produced 6% by weight of solid residues based on potassium chloride, but the burning rate was higher than that of Example 1.

The carbon monoxide content referred to a working volume of 2.7 $m^3$ was 40 ppm.

We claim:

1. Pyrotechnic composition whose combustion products are nontoxic gases free of solid residue, consisting essentially of a binder which is a thermoplastic elastomer, of an energetic plasticizer, of an oxidizing charge and additives intended to control the burning, characterized in that the said binder is an oxygen-containing thermoplastic elastomer, in that the said plasticizer is a product of polymerization of glycidyl azide and in that at least 85% of the weight of the said oxidizing charge consists of ammonium nitrate.

2. Pyrotechnic composition according to claim 1, characterized in that the said binder is a block aliphatic copolymer consisting of polyamide units and of polyether units.

3. Pyrotechnic composition according to claim 2, characterized in that the said binder is a block aliphatic copolymer of formula:

$$HO\left[\underset{\underset{O}{\|}}{C}-PA-\underset{\underset{O}{\|}}{C}-O-PE-O\right]_n H$$

in which:

C, H and O denote carbon, hydrogen and oxygen respectively,

PA denotes a polyamide block obtained by condensation of dodecanedioic acid with 1,12-dodecanediamine, PE denotes a polyether block obtained by condensation of tetraethylene glycol, n denotes an integer between 2 and 10.

4. Pyrotechnic composition according to claim 2, characterized in that the said energetic plasticizer is a polyglycidyl azide with hydroxyl ends whose average molecular mass is between 1000 and 7000.

5. Pyrotechnic composition according to claim 4, characterized in that the average molecular mass of the said polyglycidyl azide with hydroxyl ends is between 1500 and 2500.

6. Pyrotechnic composition according to claim 2, characterized in that the said additives are chosen from the group consisting of potassium nitrate and ammonium perchlorate.

7. Pyrotechnic composition according to claim 2, characterized in that the binder/energetic plasticizer combination represents between 5 and 15% of the total weight of the composition.

8. Pyrotechnic composition according to claim 7, characterized in that the weight of the energetic plasticizer represents approximately 30% of the weight of the binder/plasticizer combination.

* * * * *